US005638671A

United States Patent [19]

Stahlecker et al.

[11] Patent Number: 5,638,671

[45] Date of Patent: Jun. 17, 1997

[54] MAGNETICALLY HELD YARN WITHDRAWAL NAVEL ARRANGEMENT

[75] Inventors: Fritz Stahlecker, Josef-Neidhart-Strasse 18, 73337 Bad Überkingen; Werner Zott, Donzdorf, both of Germany

[73] Assignees: Hans Stahlecker, Süssen; Fritz Stahlecker, Bad Überkingen, both of Germany

[21] Appl. No.: 539,704

[22] Filed: Oct. 5, 1995

[30] Foreign Application Priority Data

Jan. 31, 1995 [DE] Germany ..... 195 02 917.8

[51] Int. Cl.[6] ..... D01H 4/00; B65H 57/00

[52] U.S. Cl. ..... 57/417; 57/352; 57/406

[58] Field of Search ..... 57/352, 417, 414, 57/406, 415, 407

[56] References Cited

U.S. PATENT DOCUMENTS 4,110,961 9/1978 Havel et al. ..... 57/417

4,635,436 1/1987 Malina et al. ..... 57/414

4,854,119 8/1989 Stahlecker et al. ..... 57/417

FOREIGN PATENT DOCUMENTS 2131861 1/1972 Germany ..... 57/417

*Primary Examiner*—William Stryjewski

*Attorney, Agent, or Firm*—Evenson McKeown Edwards & Lenahan, PLLC

[57] ABSTRACT

A yarn withdrawal navel for an open-end spinning apparatus is provided with a ferromagnetic locating surface. This is used for the purpose of coupling to a mounting, which has at least one permanent magnet. The yarn withdrawal navel and the mounting have abutment surfaces which are configured to vary the magnetic mounting effect on the navel as a function of the relative rotation position of the navel and the mounting.

14 Claims, 9 Drawing Sheets

MAGNETICALLY HELD YARN WITHDRAWAL NAVEL ARRANGEMENT

BACKGROUND AND SUMMARY OF THE INVENTION

The present invention relates to a yarn withdrawal navel for an open-end spinning apparatus, which yarn withdrawal navel is provided with a ferromagnetic locating surface for the purpose of coupling it to a mounting, said mounting comprising at least one permanent magnet.

A known yarn withdrawal navel of this kind (U.S. Pat. No. 4,110,961) is connected with a mounting comprising a yarn withdrawal duct and is exchangeable by means of magnetic coupling means. The yarn withdrawal navel itself can be of ferromagnetic material or it can be made from ceramic material with a ferromagnetic ring. In order to replace the yarn withdrawal navel, a tool in the shape of a supplementary magnet is used, whose magnetic force is either inverse to the force of the permanent magnet or else exceeds it.

A further known yarn withdrawal navel (U.S. Pat. No. 4,854,119) is made of ceramic material and has a ferromagnetic disk on the side facing the mounting, which disk has the same diameter as the yarn withdrawal navel. A permanent magnet in the shape of a flat ring disk is affixed to the mounting, the ring disk, having the same diameter as the ferromagnetic disk. The ring disk is recessed over a sector of approximately 60°, so that a fiber feed channel can be guided past at this point. The yarn withdrawal navel is centered with a tube-like extension in a bore hole of the permanent magnet. The publication contains no information as to how the magnetic coupling is released.

Yarn withdrawal navels capable of being coupled to mountings by magnetism have the advantage of taking up less space, as, for example, the fastening thread usually present is eliminated. Due to the elimination of the thread, a mounting made of plastic can be used. In the case of the two known yarn withdrawal navels, there are, however, no restrictions with respect to their assembly position as to the yarn axis. In some cases, however, a preferred assembly position of the yarn withdrawal navel is desirable, for example when the yarn withdrawal navel has an asymmetrical form.

An object of the present invention is to guarantee a desired assembly position in the case of a yarn withdrawal navel capable of being coupled to a mounting by magnetism and furthermore preferably to facilitate the releasing of the magnetic coupling.

This object has been achieved in accordance with the present invention by applying a positioning means to the yarn withdrawal navel which at least weakens the magnetic force on the locating surface at another assembly position of the yarn withdrawal navel other than the designated one.

Due to the features of the invention, the yarn withdrawal navel partakes in the securing of the correct assembly position. Only in the case of a particular embodiment of the yarn withdrawal navel in combination with a particular assembly position is the yarn withdrawal sufficiently magnetically secured on the mounting.

Preferably the positioning means comprises a holding notch which secures the assembly position. The respective assembly position is thus set exactly as a result of such an interlocking device.

In a particularly favorable embodiment, a positioning means in the form of a de-coupling device is used, which de-coupling device weakens or cancels the magnetic effect when the yarn withdrawal navel is turned. This means that the yarn withdrawal navel is only coupled to the mounting in a predetermined rotational position in relation to the yarn axis. The magnetic force is reduced when the yarn withdrawal navel is turned around the yarn axis. This results, in addition to the securing of a correct assembly position, in an easier releasing of the magnetic coupling when the yarn withdrawal navel is dismounted.

The decoupling device according to certain preferred embodiments comprises at least one recess in the locating surface, to which recess the permanent magnet can be disposed. By turning the yarn withdrawal navel, and therefore the ferromagnetic locating surface, around the yarn axis, the recess is pushed over the permanent magnet, whereby the magnetic force of attraction on the locating surface is lifted so that the yarn withdrawal navel can be easily dismounted. Turning can be effected, if desired, by means of a tool.

In another embodiment, the de-coupling device comprises at least one supporting surface which raises the locating surface from the mounting. When the yarn withdrawal navel is turned around the yarn axis, the ferromagnetic locating surface lifts itself off the permanent magnet. This variation has the additional advantage in that single magnets do not have to be used; if desired, a ring magnet can be used.

The yarn withdrawal navel does not have to be made completely from a ferromagnetic material, for example from steel, but can be made of a ceramic material connected to a steel ring.

These and further objects, features and advantages of the present invention will become more readily apparent from the following detailed description thereof when taken in conjunction with the accompanying drawings

DETAILED DESCRIPTION OF THE DRAWINGS

Figure 1:
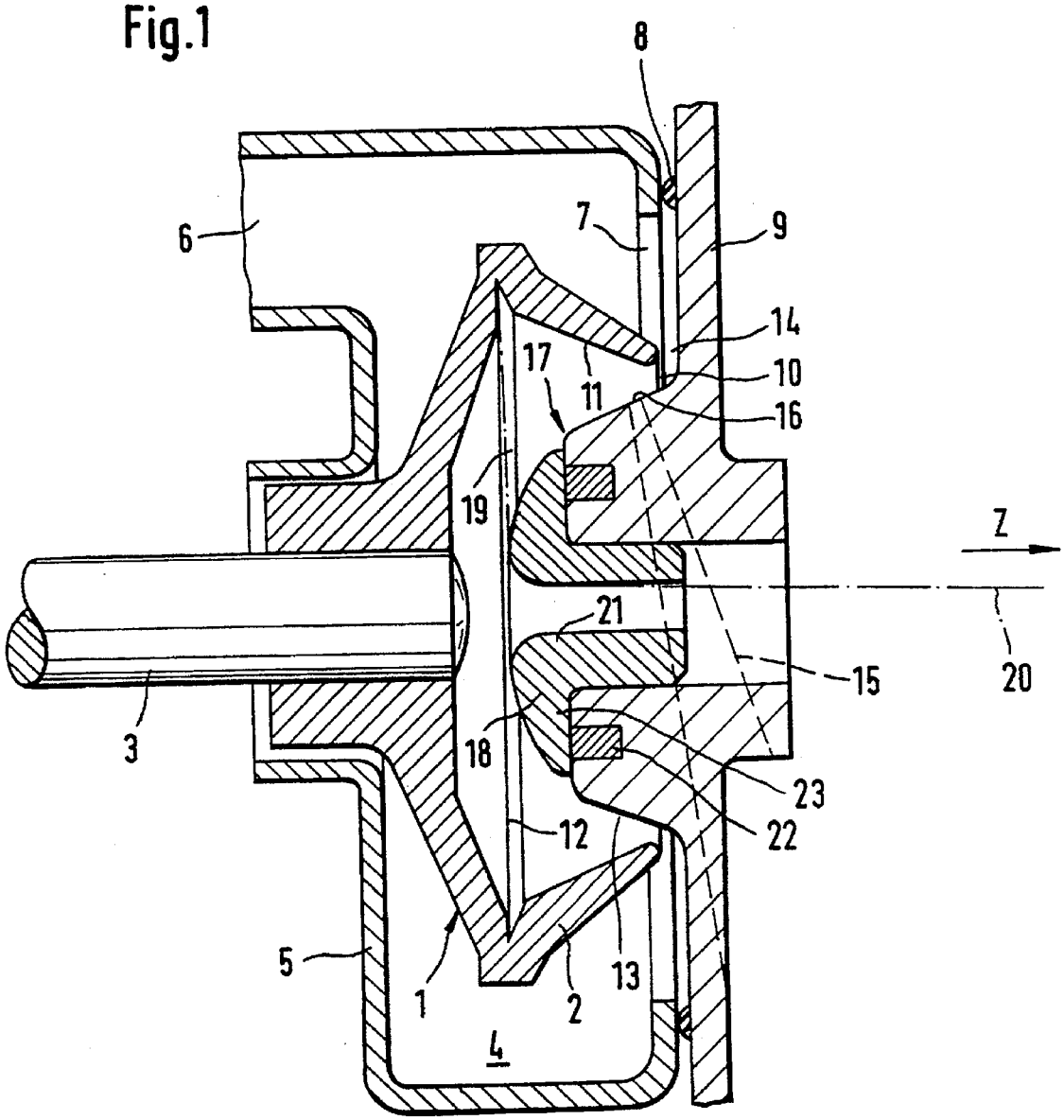
FIG. 1 is a longitudinal section through an open-end spinning apparatus in the area of a spinning rotor and yarn withdrawal navel projecting therein, constructed according to a preferred embodiment of the present invention.

The open-end spinning apparatus according to FIG. 1 comprises a spinning rotor 1, which consists in the known way of a rotor disk or disk 2 and a shaft 3 attached thereto. The rotor disk 2 rotates in a low-pressure chamber 4, which consists of a rotor housing 5 connected by a low pressure channel 6 to a vacuum source (not shown).

In order to place the spinning rotor 1 in its operational position, the rotor housing 5 is provided with an opening 7 on its operating side, which opening 7 is somewhat larger than the largest diameter of the rotor disk 2. When in operation, the opening 7 is closed by a cover part 9 in conjunction with a sealing ring 8. This simultaneously covers the open front side 10 of the rotor disk 2.

As is known, in its hollow interior the rotor disk 2 has a conically extending fiber sliding surface 11 adjacent to its open front side 10, which sliding surface 11 graduates to a fiber collecting groove 12: the fiber collecting groove 12 forms the largest diameter of the interior of the rotor disk 2. The delivered single fibers are collected in the fiber collecting groove 12 to be spun later.

The cover part 9 is provided with an extension 13, which projects through the open front side 10 of the rotor disk 2 near to the fiber collecting groove 12. Between the extension 13 and the open front side 10 of the rotor disk 2 there is an overflow gap 14, which serves to exhaust the necessary spinning air. This is delivered through a fiber feeding channel 15 in the known way and serves for the transport of the opened, single fibers to the fiber sliding surface 11. The mouth 16 of the fiber feed kneel 15, located in the extension 13, lies directly next to the fiber sliding surface 11, against which the fibers are fed, where they then slide into the fiber collecting groove 12.

The extension 13 is formed as a mounting 17 for a yarn withdrawal navel 18. The yarn withdrawal navel 18 projects almost to the fiber collecting groove 12 and serves to guide the spun yarn 19 (shown by a dot-dash line), which has been withdrawn from the fiber collecting groove 12, in the direction of its yarn axis 20, which extends approximately coaxial to the shaft 3. The spun yarn 19 is withdrawn from the yarn withdrawal navel 18 through a yarn withdrawal duct 21 in arrow direction Z and fed to a winding device (not shown).

The mounting 17 has a plurality of permanent magnets 22, preferably two or four, which can, if desired, take the form of one ring magnet. The permanent magnets 22 serve to provide a magnetic coupling of the yarn withdrawal navel 18 to the mounting 17. To this purpose, the yarn withdrawal navel 18 comprises a ferromagnetic locating surface 23. This locating surface 23 can be a ferromagnetic ring, for example a steel ring, which is attached to a ceramic yarn withdrawal navel 18. The yarn withdrawal navel 18 can also be made entirely of ferromagnetic material, for example of steel, so that the locating surface 23 is made in one piece with the yarn withdrawal navel 18.

It is advantageous when the yarn withdrawal navel 18, centered in the extension 13, rests with its locating surface 23 on the mounting 17 without any gaps, and in particular when the yarn withdrawal navel 18 does not have an undercut where fibers could collect.

The following descriptions of embodiments show various possibilities of how a yarn withdrawal navel 18 can be coupled in a predetermined assembly position to the mounting 17 and how it can also be easily released therefrom. The components corresponding to those in FIG. 1 retain their respective reference numbers and descriptions are not repeated.

In the embodiment according to FIGS. 2 to 5, as in the case of the following described variations—the respective yarn withdrawal navel 18 is centered by means of a centering sleeve 24 in a corresponding bore hole in the mounting 17. The centering sleeve 24, which also comprises the yarn withdrawal duct 21, is a peg-like extension of the actual yarn withdrawal navel.

The yard withdrawal navel 18 comprises a positioning means 25, which ensures the correct assembly position of the yarn withdrawal navel 18, whereby in the present case the positioning means 25 also takes the form of a de-coupling device 26 which facilitates an easy dismounting of the yarn withdrawal navel 18 from the mounting 17.

Figure 2:
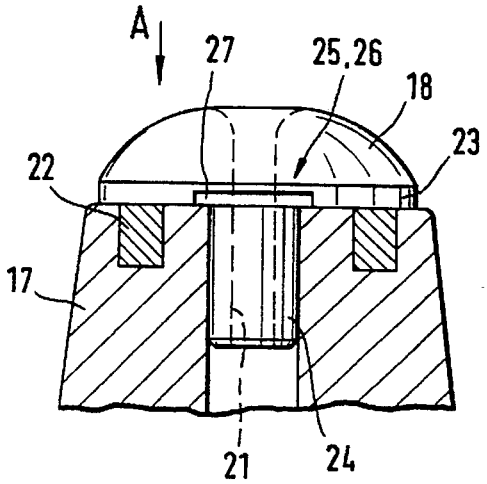
FIG. 2 is an enlarged drawing, partly axially sectioned, showing a first embodiment of a magnetic yarn withdrawal navel magnetically coupled to a mounting in operational position.
Figure 4:
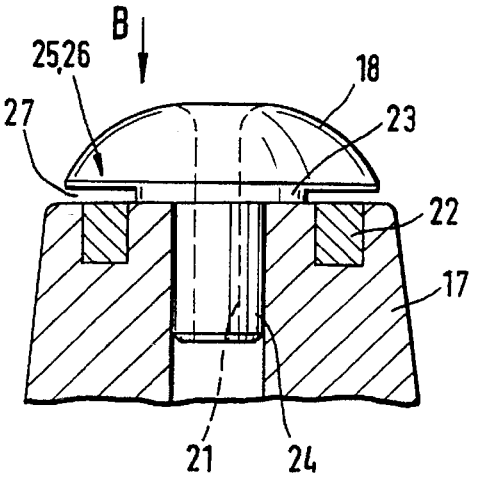
FIG. 4 is a view of the yarn withdrawal navel of FIG. 2, shown in a non-operational position.
Figure 3:
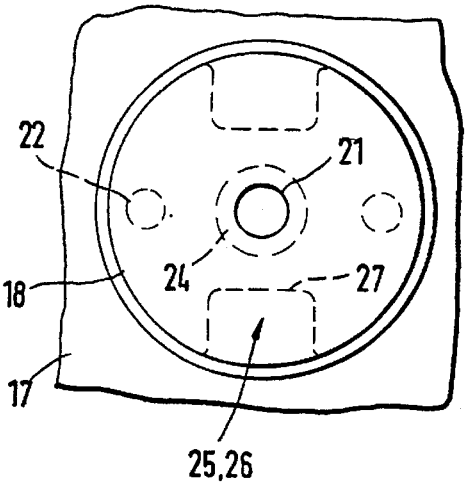
FIG. 3 is a view of the yarn withdrawal navel in the direction of the arrow A of FIG. 2.
Figure 5:
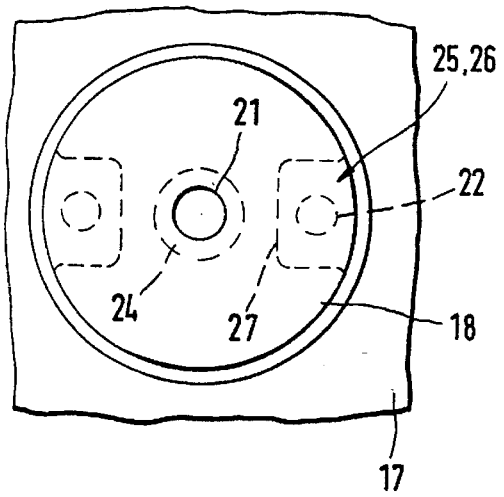
FIG. 5 is a view of the yarn withdrawal navel in arrow direction B of FIG. 4.

It can be seen from FIG. 3 that in this embodiment two diametrically opposed permanent magnets 22 are set into the front surface of the mounting 17 which projects into the rotor disk 2. The ferromagnetic locating surface 23 of the yarn withdrawal navel 18 rests on these two permanent magnet 22 in the assembly position, which corresponds to the spinning position. The ferromagnetic locating surface 23 is provided with two recesses 27, which are also diametrically opposed, each however out of line by 90° to the permanent magnets 22. These can be pushed over the two permanent magnets 22 when the yarn withdrawal navel 18 is turned around the yarn axis 20. The recesses 27 extend from the circumferential side of the disk-like locating surface 23 so far over to the centering sleeve 24 that the permanent magnets 22 come to rest entirely in the recess 27. In the direction of the yarn axis 20, the respective recess 27 is so high or deep that when the recesses 27 are placed in position over the permanent magnets 22, the magnetic force on the ferromagnetic locating surface 23 is considerably lessened. The yarn withdrawal navel can thus be easily dismounted from the mounting 17 in this non-operational position. This non-operational position is shown in FIGS. 4 and 5. The assembly position as shown in FIGS. 2 and 3 is, in contrast, then secured when the recesses 27 do not lie in the area of the permanent magnets 22. There is a certain amount of tolerance for the assembly position as the assembly position is not held fast by a holding notice in this embodiment.

Figure 6:
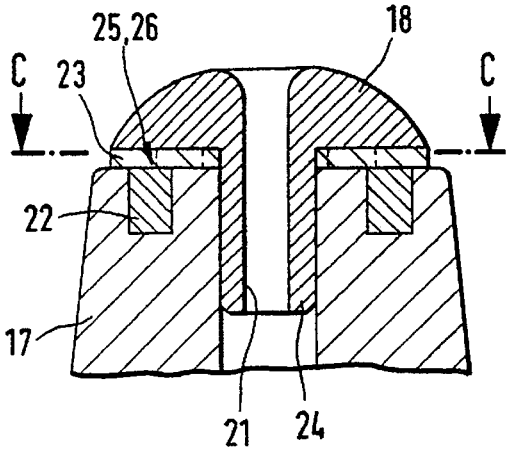
FIG. 6 is an enlarged drawing, partly axially sectioned, showing a second embodiment of a magnetic yarn withdrawal navel magnetically coupled to a mounting in operational position.
Figure 8:
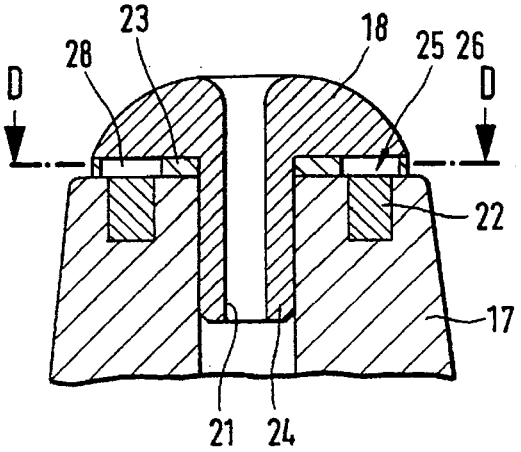
FIG. 8 is a view of the yarn withdrawal navel of FIG. 6, shown in a non-operational position.
Figure 7:
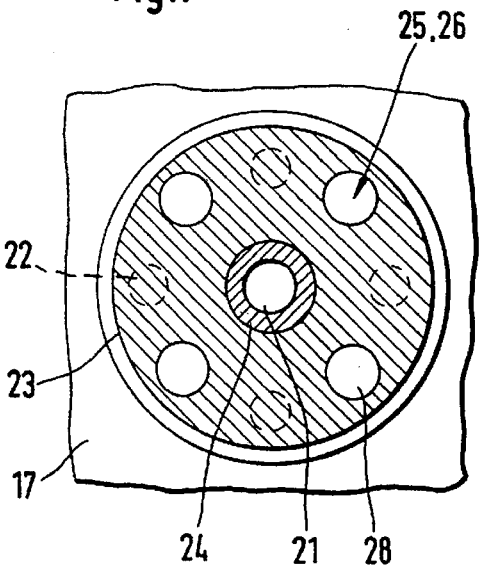
FIG. 7 is a sectional view of the yarn withdrawal navel of FIG. 6, taken along Section C—C of FIG. 6.
Figure 9:
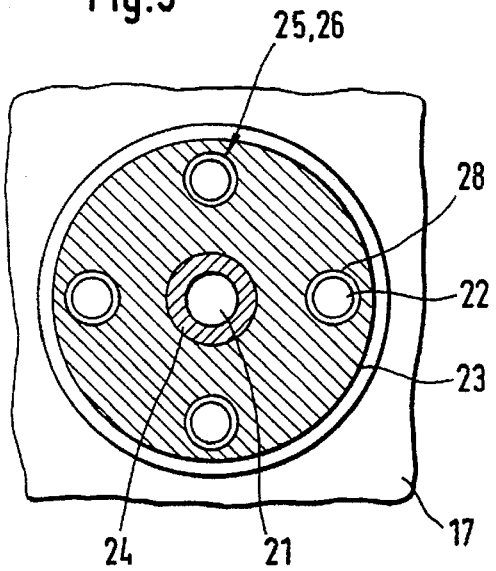
FIG. 9 is a sectional view of the yarn withdrawal navel of FIG. 8, taken along Section D—D of FIG. 8.

Another embodiment is shown in FIGS. 6 to 9, whereby the FIGS. 6 and 7 show the assembly position of the yarn withdrawal navel 18 and the FIGS. 8 and 9 show the non-operational position of the yarn withdrawal navel 18. FIG. 7 is a view of the FIG. 6 along the sectional surface C—C; FIG. 9 is a view of FIG. 8 along the sectional surface D—D.

In the case of this embodiment, the yarn withdrawal navel 18, including the centering pin 24, consists of ceramic, whereby a ring-shaped, disk-like ferromagnetic locating surface 23 is pressed securely onto the centering pin 24. In the present case the mounting 17 ha four permanent magnets 22 altogether, which hold the locating surface 23 securely in the assembly position. In this embodiment, too, the assembly position is not fixed exactly, as there is no holding notch.

The locating surface 23 is provided with four recesses 28 altogether, which take the shape of through holes in the ring-shaped, disk-like locating surface 23, and which, when the yarn withdrawal navel 18 is turned around the yarn axis 20, can be brought to coincidence with the permanent magnets 22, as can be seen in FIGS. 8 and 9. In the latter position, the magnetic force is lifted on the locating surface 23, so that the yarn withdrawal navel 18 can be easily removed from the mounting 17. The embodiment according to FIGS. 6 to 9 is similar therefore to the embodiment according to FIGS. 2 to 5. In both cases, the positioning means 25 is also a de-coupling device 26.

Figure 10:
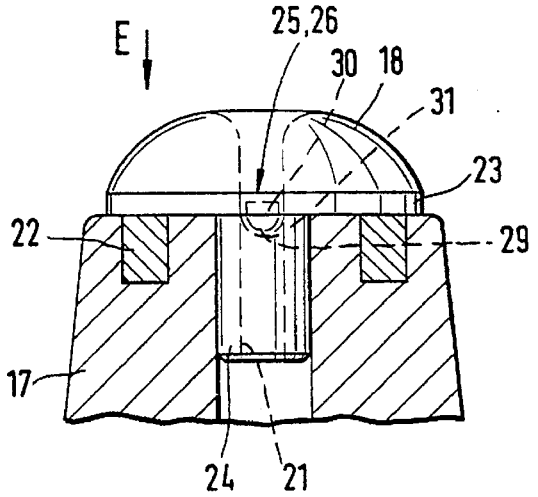
FIG. 10 is an enlarged drawing, partly axially sectioned, showing a third embodiment of a magnetic yarn withdrawal navel magnetically coupled to a mounting in operational position.
Figure 12:
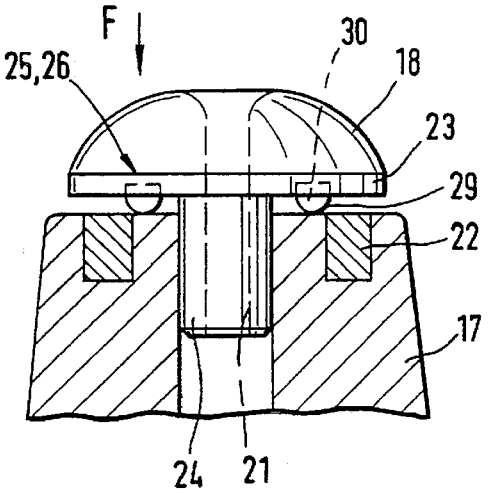
FIG. 12 is a view of the yarn withdrawal navel of FIG. 10, shown in a non-operational position.
Figure 11:
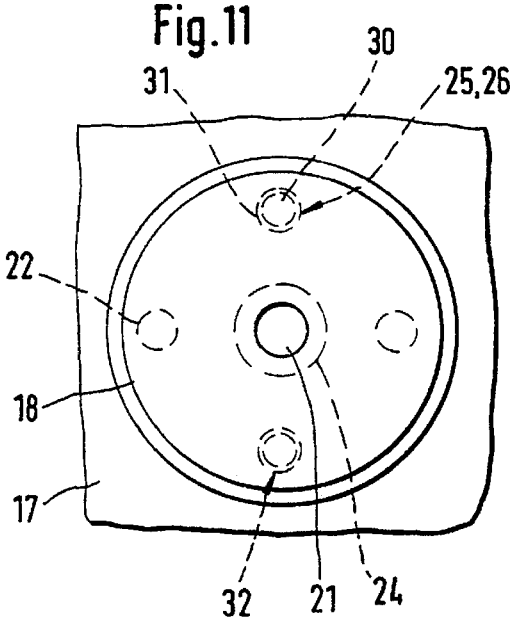
FIG. 11 is a view of the yarn withdrawal navel in the direction of the arrow E of FIG. 10.
Figure 13:
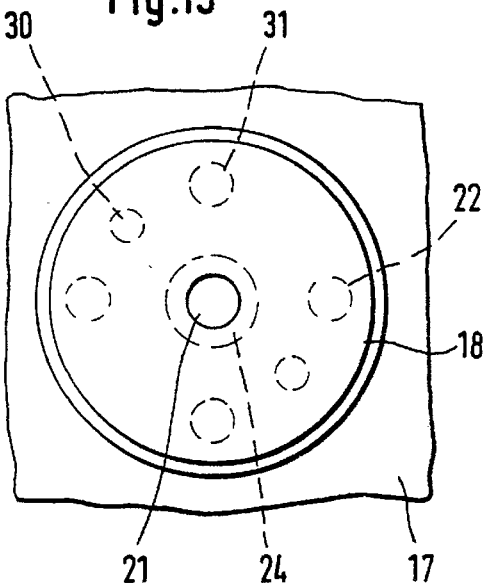
FIG. 13 is a view of the yarn withdrawal navel in arrow direction F of FIG. 12.

A further embodiment is shown in FIGS. 10 to 13, whereby the FIGS. 10 and 11 show the assembly position and the FIGS. 12 and 13 show the non-operational position of the yarn withdrawal navel 18. FIG. 11 is a view in the direction of the arrow E of FIG. 10, FIG. 13 is a view in the direction of the arrow F of FIG. 12.

In the case of this embodiment, an exact spinning position can be set, as the assembly position is secured by a holding notch 32. For this, two elevations 30 are present on the front surface of the ferromagnetic locating surface 23 facing the mounting 17, which can take the shape of plastic inserts.

In the assembly position, these elevations 30 interlock with corresponding, preferably hemispherically shaped recesses 31 in the mounting 17. When the yarn withdrawal navel 18 is turned around the yarn axis 20, the elevations 30 are brought into the position shown in FIGS. 12 and 13, in which the ferromagnetic locating surface 23 is raised so far from the front surface of the mounting 17 that the magnetic force is at least reduced. This has the advantage that instead of two permanent magnets 22, a ring magnet can be used. Advantageously, the elevations 30, of which more than two may be present, are divided over the circumference of the locating surface 3 in such a way that the locating surface 23 is completely raised from the mounting 17. This would not be the case if only one elevation 30 was present. The positioning means 25 is, in this case too, also a de-coupling device 26.

Figure 14:
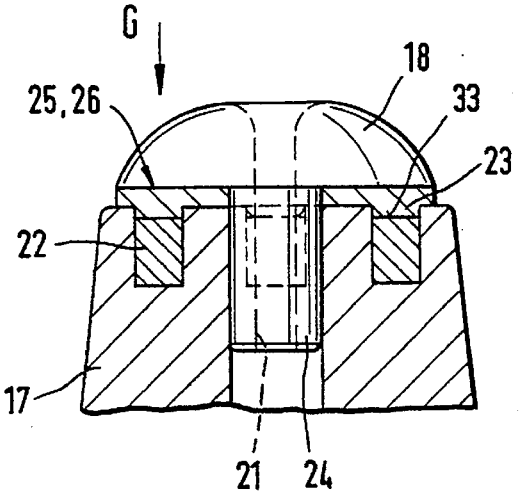
FIG. 14 is an enlarged drawing, partly axially sectioned, showing a fourth embodiment of a magnetic yarn withdrawal navel magnetically coupled to a mounting in operational position.
Figure 16:
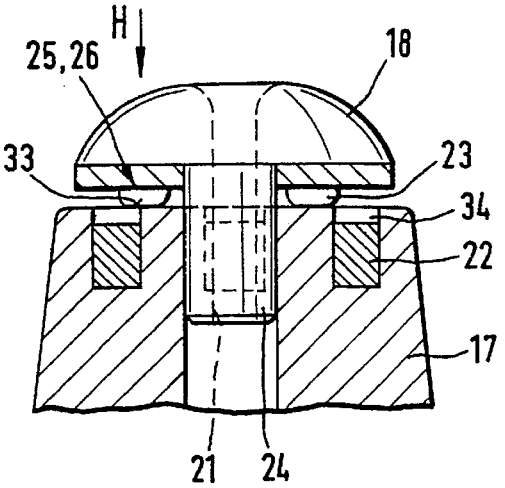
FIG. 16 is a view of the yarn withdrawal navel of FIG. 14, shown in a non-operational position.
Figure 15:
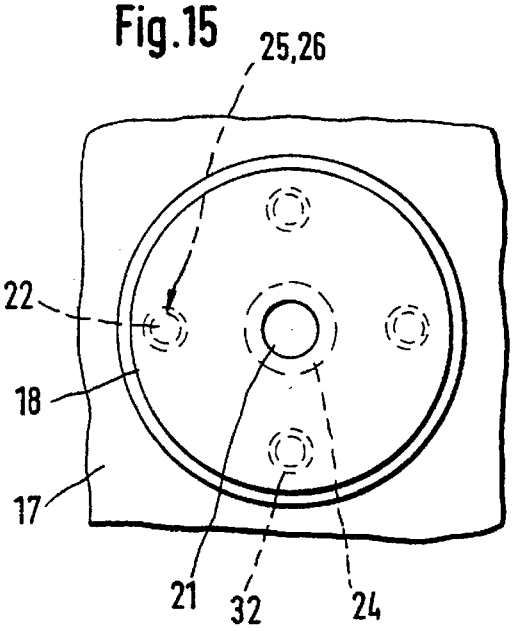
FIG. 15 is a view of the yarn withdrawal navel in the direction of the arrow G of FIG. 14.
Figure 17:
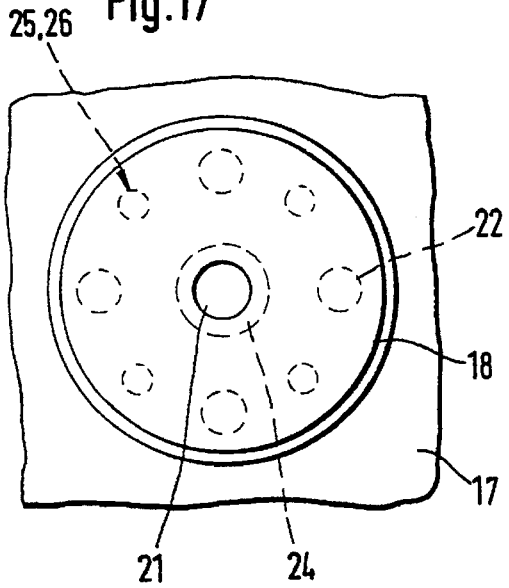
FIG. 17 is a view of the yarn withdrawal navel in arrow direction H of FIG. 16.

FIGS. 14 to 17 show a further embodiment, whereby FIGS. 14 and 15 show the assembly position and FIGS. 16 and 17 show the non-operational position of the yarn withdrawal navel 18. FIG. 15 is viewed in arrow direction G of FIG. 14, while FIG. 17 is viewed in arrow direction H of FIG. 16.

In the case of this embodiment, there is also a holding notch 32 which is formed in that the front side of the ferromagnetic locating surface 23, which faces the mounting 17, is equipped with four supporting surfaces 33 which take the shape of cam-like elevations. Four permanent magnet 22 of the mounting 17 are arranged to the supporting surfaces 33. The permanent magnets 22 are hereby arranged somewhat lower, so that between them and the front surface of the mounting 17 a small recess 34 remains free, into which the supporting surfaces 33 can be inserted in the assembly position. In the case of this embodiment, the supporting surfaces 33 are formed by the ferromagnetic locating surface 23 itself. When the yarn withdrawal navel 18 is turned around the yarn axis 20, the supporting surfaces 33 are brought into the position shown in FIGS. 16 and 17, in which the supporting surfaces 33 do not interlock with the recesses 33, so that the yarn withdrawal navel 18 is raised somewhat from the mounting 17 and can be easily dismounted. The positioning means 25 is, in this case, also a de-coupling device 26.

Figure 18:
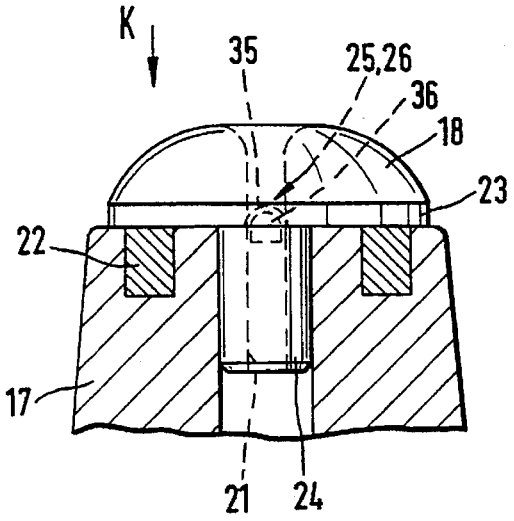
FIG. 18 is an enlarged drawing, partly axially sectioned, showing a fifth embodiment of a magnetic yarn withdrawal navel magnetically coupled to a mounting in operational position.
Figure 20:
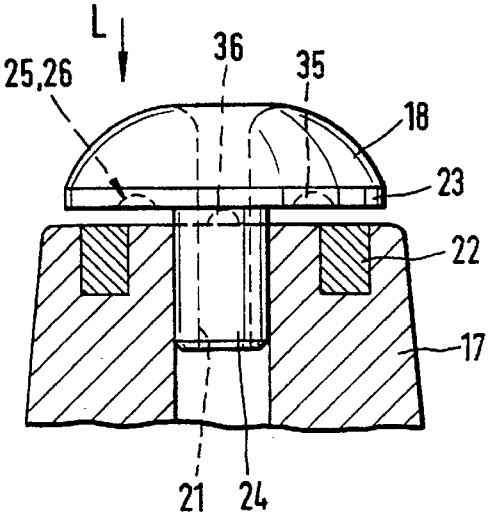
FIG. 20 is a view of the yarn withdrawal navel of FIG. 18, shown in a non-operational position.
Figure 19:
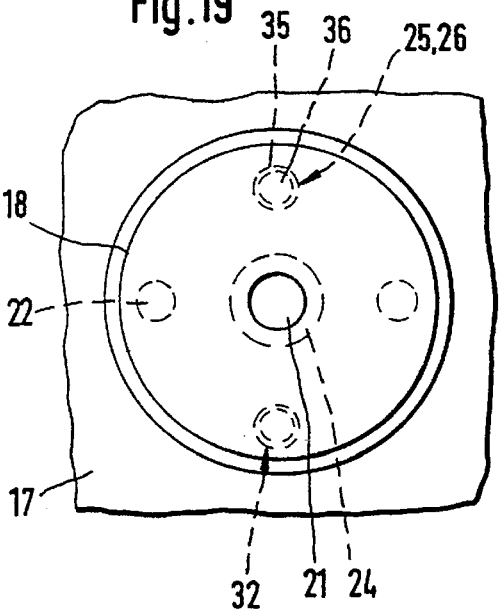
FIG. 19 is a view of the yarn withdrawal navel in the direction of the arrow K of FIG. 18.
Figure 21:
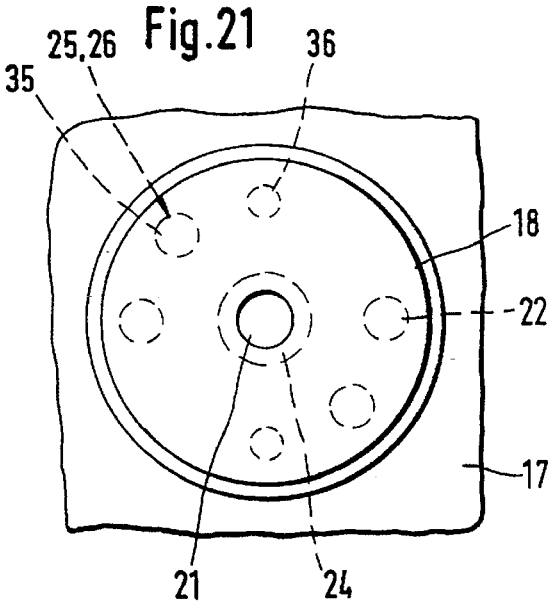
FIG. 21 is a view of the yarn withdrawal navel in arrow direction L of FIG. 20.

A further embodiment is shown in FIGS. 18 to 21, whereby the FIGS. 18 and 19 show the assembly position and FIGS. 20 and 21 show the non-operational position. FIG. 19 is hereby view in arrow direction K of FIG. 18, and FIG. 21 is a view in arrow direction L of FIG. 20.

This embodiment corresponds to a large extent to the variation according to FIGS. 10 to 13, whereby in this case however the elevations 36 are disposed on the mounting 17, and the recesses 35 on the ferromagnetic locating surface 23 on the side facing the mounting 17. The positioning means 25, which is in this case also a de-coupling device, serves in addition as a holding notch 32 for securing the exact spinning position.

When the yarn withdrawal navel 18 is turned around the yarn axis 20, the ferromagnetic locating surface 23 is raised so far from the front sided of the mounting 17 that the magnetic coupling effect is sufficiently reduced. The yarn withdrawal navel 18 can be easily removed from the mounting 17 in this non-operational position.

Figure 22:
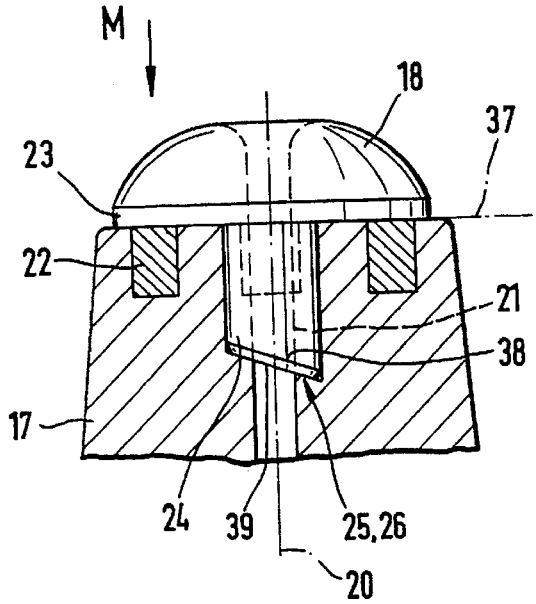
FIG. 22 is an enlarged drawing, partly axially sectioned, showing a sixth embodiment of a magnetic yarn withdrawal navel magnetically coupled to a mounting in operational position.
Figure 24:
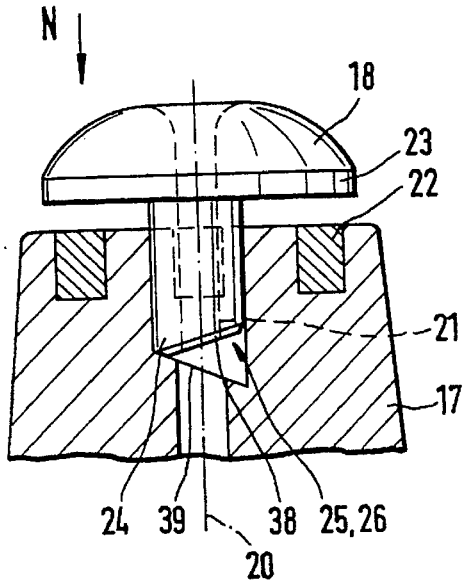
FIG. 24 is a view of the yarn withdrawal navel of FIG. 22, shown in a non-operational position.
Figure 23:
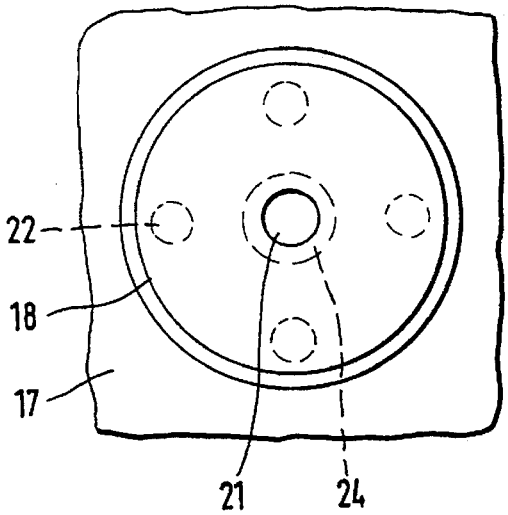
FIG. 23 is a view of the yarn withdrawal navel in the direction of the arrow M of FIG. 22.
Figure 25:
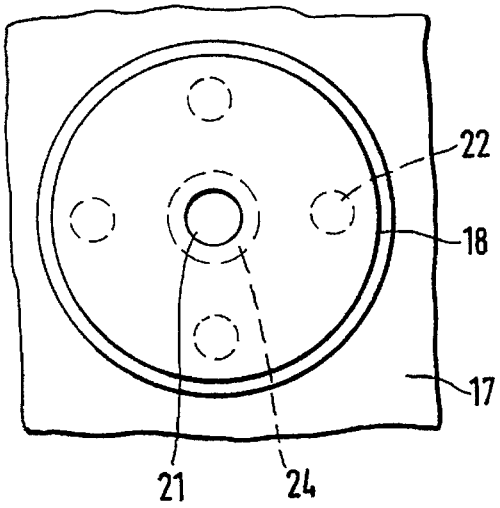
FIG. 25 is a view of the yarn withdrawal navel in arrow direction N of FIG. 24.

A further variation is shown in FIGS. 22 to 25, of which FIGS. 22 and 23 show the assembly position and FIGS. 24 and 25 the disassembly position of the yarn withdrawal navel 18. FIG. 23 is hereby a view in arrow direction M of FIG. 22, while FIG. 25 is a view of arrow direction N of FIG. 24.

In the case of this embodiment, there is also a supporting surface 38, which serves the lifting of the ferromagnetic locating surface 23 from the mounting 17 when the yarn withdrawal navel 18 is turned around the yarn axis 20. The supporting surface 38 is, however, applied to the front side of the centering sleeve 24 facing away from the locating surface 23. This front side formed as a supporting surface 38 is somewhat inclined to the normal plane 37 of the yarn axis, whereby a correspondingly inclined counter-surface 39 of the mounting is arranged to the supporting surface 38. The supporting surface 38 thus forms the positioning means 25 and also the de-coupling device 26.

In the assembly position, the supporting surface 38 lies on the counter-surface 39 of the mounting 17 in a closely fitting position. When the yarn withdrawal navel 18 is turned, for example, around 180°, as shown in FIGS. 24 and 25, one side of the supporting surface 38 is raised to such an extent from its counter-surface 39 that the ferromagnetic locating surface 23 is correspondingly raised from the mounting 17. The magnetic force on the yarn withdrawal navel 18 is thus interrupted to a large extent. In the case of this embodiment, the four shown permanent magnets 22 can be replaced with a ring magnet.

Figure 26:
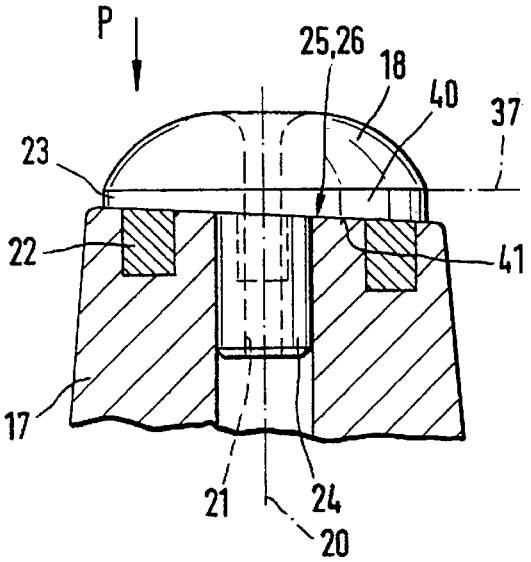
FIG. 26 is an enlarged drawing, partly axially sectioned, showing a seventh embodiment of a magnetic yarn withdrawal navel magnetically coupled to a mounting in operational position.
Figure 28:
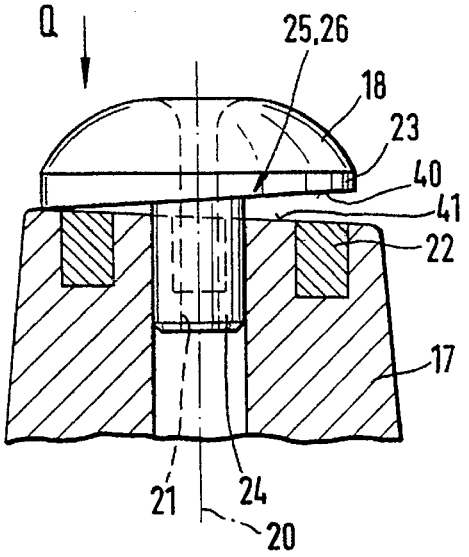
FIG. 28 is a view of the yarn withdrawal navel of FIG. 26, shown in a non-operational position.
Figure 27:
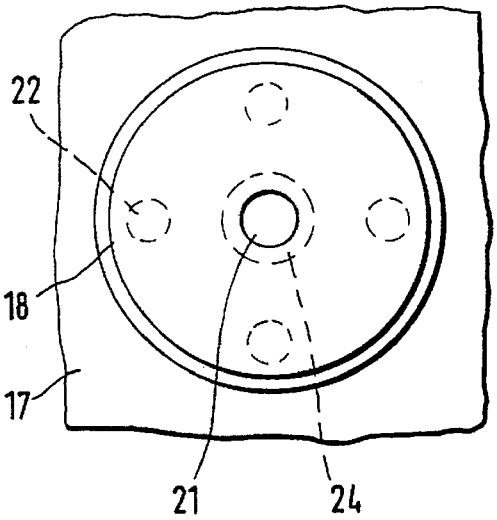
FIG. 27 is a view of the yarn withdrawal navel in the direction of the arrow P of FIG. 26.
Figure 29:
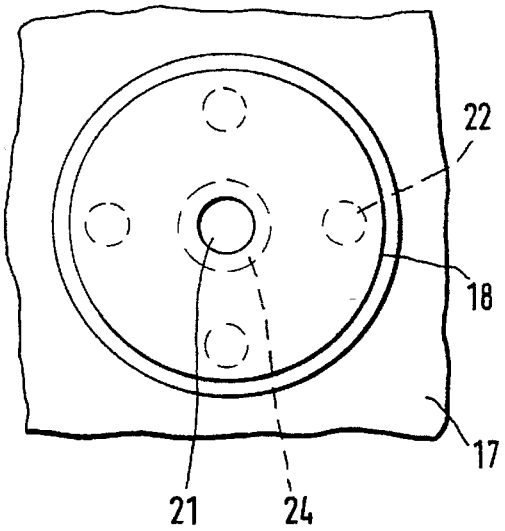
FIG. 29 is a view of the yarn withdrawal navel in arrow direction Q of FIG. 28.

A further embodiment is shown in FIGS. 26 to 29, of which the FIGS. 26 and 27 show the assembly position and the FIGS. 28 and 29 show the non-operational position of the yarn withdrawal navel 18. FIG. 27 is a view in the direction of arrow P of FIG. 26, and FIG. 29 is a view in the direction of the arrow Q of FIG. 28.

This embodiment is similar to the embodiment according to the FIGS. 22 to 25, with the difference that the supporting surface 40 is not located at the centering sleeve 24, but directly on the ferromagnetic locating surface 23. The supporting surface 40, as can be clearly seen from FIGS. 26 and 28, is inclined to the normal plane 37 to such an extent that when the yarn withdrawal navel 18 is turned, the locating surface 23 is lifted from the mounting 17 on one side. The front side of the mounting 17 facing the locating surface 23 is formed as a counter-surface 41, which is inclined towards the normal plane 37 in relation to the yarn axis 20. The positioning means 25 is, in this case, also a de-coupling device 26.

Figure 30:
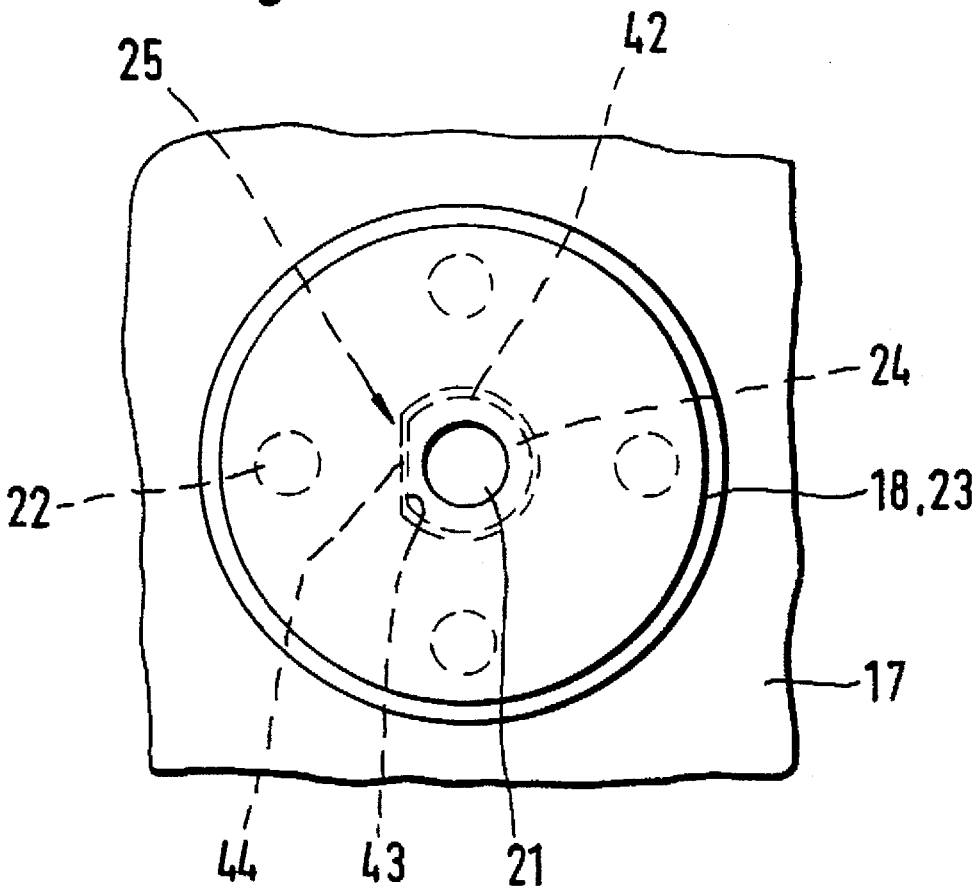
FIG. 30 is a view onto a yarn withdrawal navel similar to FIG. 3, with a segment-like flattening of a centering sleeve located on the yarn withdrawal navel.

FIG. 30 shows a yarn withdrawal navel 18 in a view similar to FIG. 3, that is, in the assembly position. The centering sleeve 24 is provided with at least one segment-like flattening 43 on its outer sleeve surface 42, which is arranged to a correspondingly formed counter-surface 44 of the mounting 17. The flattening 43 forms a positioning means 25, which, in the case of this embodiment—and unlike all other embodiments—is not also a de-coupling device. In the embodiment according to FIG. 30, the yarn withdrawal navel 18 can only be mounted in the correct assembly position in advance. However, the advantage of being able to magnetically uncouple the yarn withdrawal navel 18 from the mounting 17 when the locating surface 23 is turned is lost. The yarn withdrawal navel 18 must be wrenched from the mounting 17 by means of tongs.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A yarn withdrawal navel assembly for an open-end rotor spinning machine, comprising:

a mounting member adapted to protrude into an open side of a spinning rotor, a yarn withdrawal navel, and at least one holding magnet provided at one of said mounting member and said navel, wherein said at least one holding magnet, navel and mounting member are configured such that magnetic forces between said navel and mounting member vary in dependence on the relative rotational position of the navel and mounting member to thus facilitate selective attachment and detachment of said navel from said mounting member.

2. A yarn withdrawal navel assembly according to claim 1, wherein said at least one holding magnet is provided at said mounting member.

3. A yarn withdrawal navel assembly according to claim 1, wherein said navel and mounting member include respective facing abutment surfaces which force axial movement of the navel with respect to the mounting member in response to the relative rotational movement of the navel and mounting member.

4. A yarn withdrawal navel assembly according to claim 3, wherein a centrally arranged centering sleeve is arranged on the yarn withdrawal navel, said centering sleeve having a supporting surface inclined with respect to a radial plane through a yarn withdrawal axis of the navel, and wherein a correspondingly inclined counter-surface of the mounting faces the supporting surface.

5. A yarn withdrawal navel assembly according to claim 1, wherein said navel and mounting member include respective interengageable detent sections.

6. A yarn withdrawal navel assembly according to claim 1, wherein said navel and mounting member include respective facing mounting surfaces which are inclined with respect to a yarn withdrawal axis through the navel when the navel is in an in-use installed position.

7. A yarn withdrawal navel assembly according to claim 1, comprising at least one holding protrusion on one of the navel and mounting member, engageable in a corresponding at least one holding recess of the other of the navel and mounting member when in an in-use rotated position of the navel and holding member.

8. A yarn withdrawal navel assembly according to claim 7, wherein said at least one protrusion and at least one recess include mating cam surfaces which accommodate axial movement of the navel and mounting member with respect to one another in dependence on their relative rotative positions.

9. A yarn withdrawal navel for an open-end rotor spinning machine of the type having a mounting member adapted to protrude into an open side of a spinning rotor and at least one navel holding magnet, wherein said navel is configured such that magnetic forces between said navel and mounting member are varied in dependence on the relative rotational position of the navel and mounting member to thus facilitate selective attachment and detachment of said navel from said mounting member.

10. A yarn withdrawal navel according to claim 9, wherein said at least one holding magnet is provided at said mounting member.

11. A yarn withdrawal navel according to claim 9, wherein said navel includes abutment surfaces which in use face and engage an abutment surface of the mounting member in such manner as to force axial movement of the navel with respect to the mounting member in response to the relative rotational movement of the navel and mounting member.

12. A yarn withdrawal navel according to claim 9, wherein the yarn withdrawal navel includes a centrally arranged centering sleeve having a supporting surface inclined with respect to a radial plane through a yarn withdrawal axis through the navel, said supporting surface being engageable in use with a correspondingly inclined counter-surface of the mounting.

13. A yarn withdrawal navel according to claim 9, wherein said navel includes at least one holding protrusion and a holding recess engageable in a corresponding at least one holding recess and holding protrusion of the mounting member when in an in-use rotative position of the navel and holding member.

14. A yarn withdrawal navel according to claim 13, wherein said at least one holding protrusion and notch include mating cam surfaces which accommodate axial movement of the navel and mounting member with respect to one another in dependence on their relative rotative positions.

* * * * *